US007367471B1

(12) United States Patent
Ip

(10) Patent No.: US 7,367,471 B1
(45) Date of Patent: May 6, 2008

(54) VENDING APPARATUS

(75) Inventor: Ming Ip, West Hempstead, NY (US)

(73) Assignee: Genesis Manufacturing, Inc., West Hempstead, NY (US)

( * ) Notice: Subject to any disclaimer, the term of this patent is extended or adjusted under 35 U.S.C. 154(b) by 0 days.

(21) Appl. No.: 11/650,706

(22) Filed: Jan. 8, 2007

(51) Int. Cl.
*G07F 11/00* (2006.01)

(52) U.S. Cl. ..... 221/75; 221/85

(58) Field of Classification Search ..... 221/75, 221/312 R, 156, 85
See application file for complete search history.

(56) References Cited

U.S. PATENT DOCUMENTS

| | | | | |
|---|---|---|---|---|
| 1,702,554 A | | 2/1929 | Walker | |
| 2,564,552 A | * | 8/1951 | Verdery, Jr. | 221/75 |
| 3,273,748 A | | 9/1966 | De Shon et al. | |
| 3,815,781 A | * | 6/1974 | Armstrong et al. | 221/75 |
| 4,061,245 A | * | 12/1977 | Lotspeich | 221/75 |
| 4,258,860 A | | 3/1981 | Boettcher | |
| 4,312,460 A | | 1/1982 | Boettcher | |
| 4,363,422 A | * | 12/1982 | Boettcher | 221/75 |
| 4,369,896 A | * | 1/1983 | Boettcher | 221/75 |
| 4,674,653 A | * | 6/1987 | Suzuki | 221/6 |
| 5,064,092 A | * | 11/1991 | Grossi | 221/75 |
| 5,333,754 A | * | 8/1994 | Kobayashi | 221/75 |
| 5,341,954 A | * | 8/1994 | Smith | 221/85 |
| 7,066,348 B2 | * | 6/2006 | Skavnak | 221/75 |

* cited by examiner

*Primary Examiner*—Gene O. Crawford
*Assistant Examiner*—Rakesh Kumar
(74) *Attorney, Agent, or Firm*—Collard & Roe, P.C.

(57) ABSTRACT

A vending apparatus has a housing and at least one rotatable dispensing coil disposed within the housing. The coil is vertically oriented and rotates in a manner such that products placed between the rungs of the coil move progressively downward during rotation until each product is ejected from a bottom end of the coil. There are retaining walls surrounding the coil on opposite sides of the coil. The walls extend an entire length of the coil but do not encompass the entire circumference of the coil, so that two longitudinal portions of the coil located opposite one another are not surrounded by the retaining walls. A product having a length exceeding the diameter of the coil can be placed in the coil for vending so that the ends of the product extend beyond the coil through the two portions not surrounded by the retaining walls. The retaining walls prevent the product from rotating when the coil rotates, and keep the product moving progressively down the coil until it is ejected from the coil.

8 Claims, 3 Drawing Sheets

VENDING APPARATUS

BACKGROUND OF THE INVENTION

1. Field of the Invention

This invention relates to a vending apparatus that is suitable for vending elongated objects. In particular the invention relates to a vending apparatus utilizing vertically oriented vending slots with vertical coils disposed therein. There is also a semicircular retaining structure disposed on each side of each slot, to prevent the products from rotating as the coil rotates.

2. The Prior Art

Standard vending machines typically have several vending slots disposed in horizontal rows in the machine. The slots are horizontally oriented, with a rotating coil disposed in each slot. The vended products are placed between the wires of the coils, and are released as the coil rotates after the required fee has been deposited. The released product is pushed to the front of the machine where it can then drop to the bottom for retrieval by the user.

One of the disadvantages of this type of apparatus is that the product often becomes stuck in the coil and is not released. The user then has to put more money into the machine to buy a second product, at which point two products are released.

There have been attempts to prevent these problems by devising vending machines where the slots are disposed vertically, so that gravity can aid in the removal of the product from the coils. Some versions of these devices are described in U.S. Pat. No. 5,064,092 to Grossi, U.S. Pat. Nos. 4,363,422, 4,369,896, 4,258,860 and 4,312,460, all to Boettcher, U.S. Pat. No. 3,815,781 to Armstrong et al., U.S. Pat. No. 4,674,653 to Suzuki, U.S. Pat. No. 5,333,754 to Kobayashi, U.S. Pat. No. 1,702,554 to Walker, and U.S. Pat. No. 3,273,748 to De Shon et al. While these devices allow the dispensing of small objects such as candy bars and bags of snack foods, they are not suitable for dispensing irregularly shaped items, especially those that are long and thin, such as beef jerky, powdered drink mix tubes, cigars and writing implements.

SUMMARY OF THE INVENTION

It is therefore an object of the invention to provide a vending apparatus that is capable of dispensing long, irregularly shaped items in an efficient manner without risk of their becoming stuck in the coils.

This object is accomplished by a vending apparatus having a housing and at least one rotatable dispensing coil disposed within the housing. The coil is vertically oriented and rotates in a manner such that products placed between the rungs of the coil move progressively downward during rotation until each product is ejected from a bottom end of the coil. There are two semi-circular retaining walls surrounding the coil on opposite sides of the coil. The walls extend an entire length of the coil but do not encompass the entire circumference of the coil, so that there are two longitudinally extending gaps in the walls, located on opposite sides of the coil from each other.

A product having a length exceeding the diameter of the coil can be placed in the coil for vending so that the ends of the product extend beyond the coil through the gaps. The retaining walls prevent the product from rotating when the coil rotates, and keep the product moving progressively down the coil until it is ejected from the coil.

There is preferably a motor for driving the coil. However other driving means could be used. The motor is preferably a gear driven motor. There is a funds receiving device connected to the motor, such that the motor causes the coil to rotate a predetermined number of degrees when a predetermined amount of money is placed in said funds receiving device. The cost of each product is determined by the vendor, and this amount is entered into a control unit in the funds receiving device. When this amount has been reached, and the product has been selected, the motor causes the coil to rotate and dispense the selected item. The number of degrees of rotation is selected based upon how much rotation is required to dispense each product. Each product is placed an equal distance from neighboring products on the same coil, so that the required amount of rotation is the same for each vending operation.

There is preferably slot in a bottom area of the housing for retrieving products ejected from the coil. When the product is ejected, it falls to the bottom of the housing where it can be retrieved by the user.

Any number of coils can be disposed in the housing, but there are preferably at least three coils disposed in the housing, so that a variety of products may be offered. Each coil has its own motor and there are selection buttons disposed on the housing and connected to the corresponding motor, so that the user can select which coil to rotate after the funds have been transmitted.

There is preferably a sensor mounted near a bottom end of the coil. The sensor senses when there are no products remaining in the coil, which can then trigger a notice on a display, to notify customers that the product is sold out.

The coils and the gaps between the retaining walls can be manufactured to accommodate a large range of product sizes. In a preferred embodiment for dispensing powdered drink mix tubes, the space between the retaining walls of each coil is approximately 0.5 inches in width.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
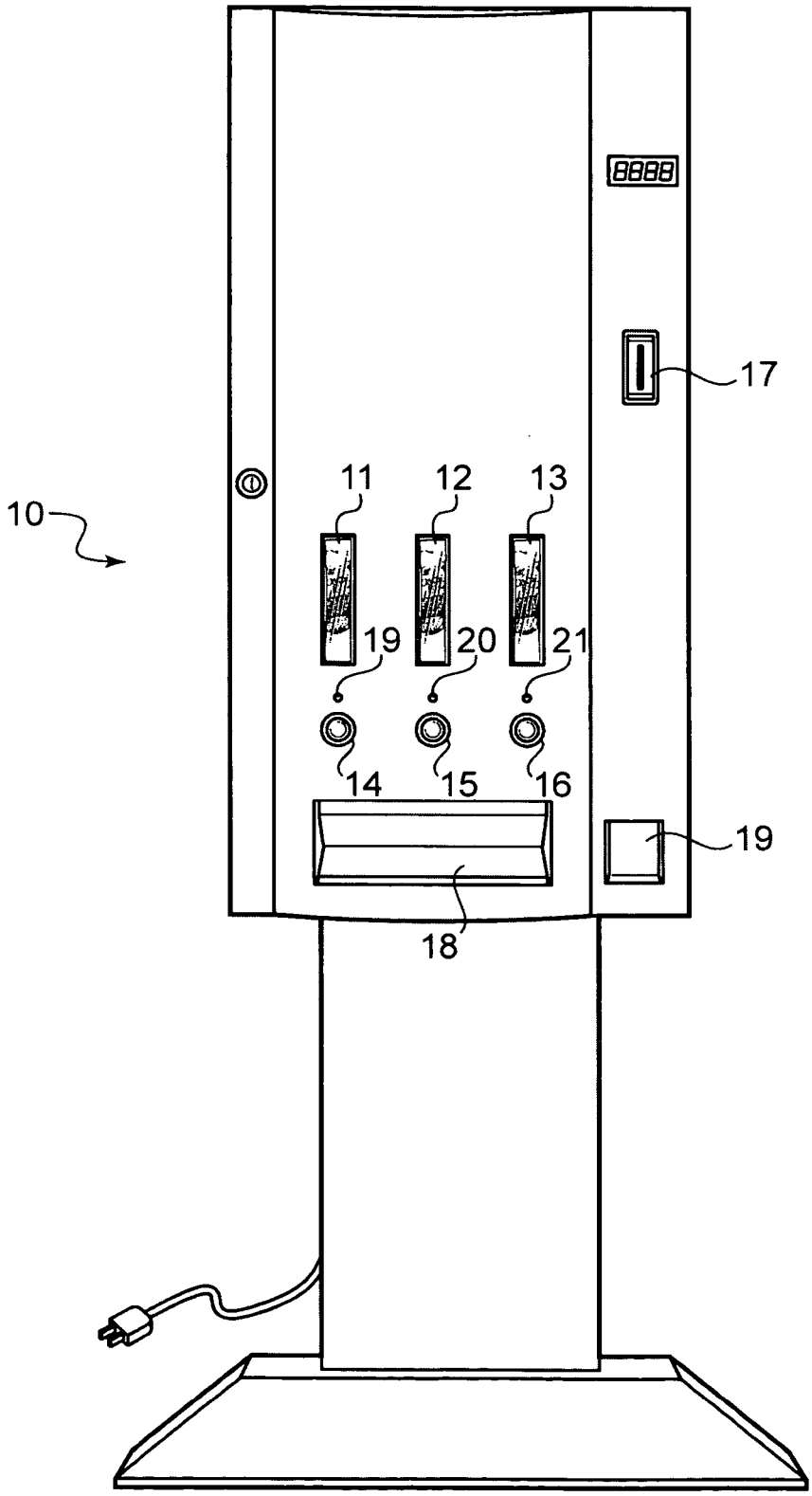
FIG. 1 shows a front view of one embodiment of a vending machine according to the invention.

Referring now in detail to the drawings, FIG. 1 shows a front view of one embodiment of a vending machine 10 according to the invention. Vending machine 10 has three vending chambers with viewing windows 11, 12, 13 and selection buttons 14, 15, 16. Viewing windows 11-13 allow the purchaser to see which products are being vended in each chamber. Each vending chamber is also equipped with an "empty" indicator 19, 20, 21 to indicate when a chamber is empty of product. There is a coin receiver 17 for receiving funds, and a dispensing slot 18 for retrieving vended products. A coin return chamber is located underneath coin receiver 17.

Figure 2:
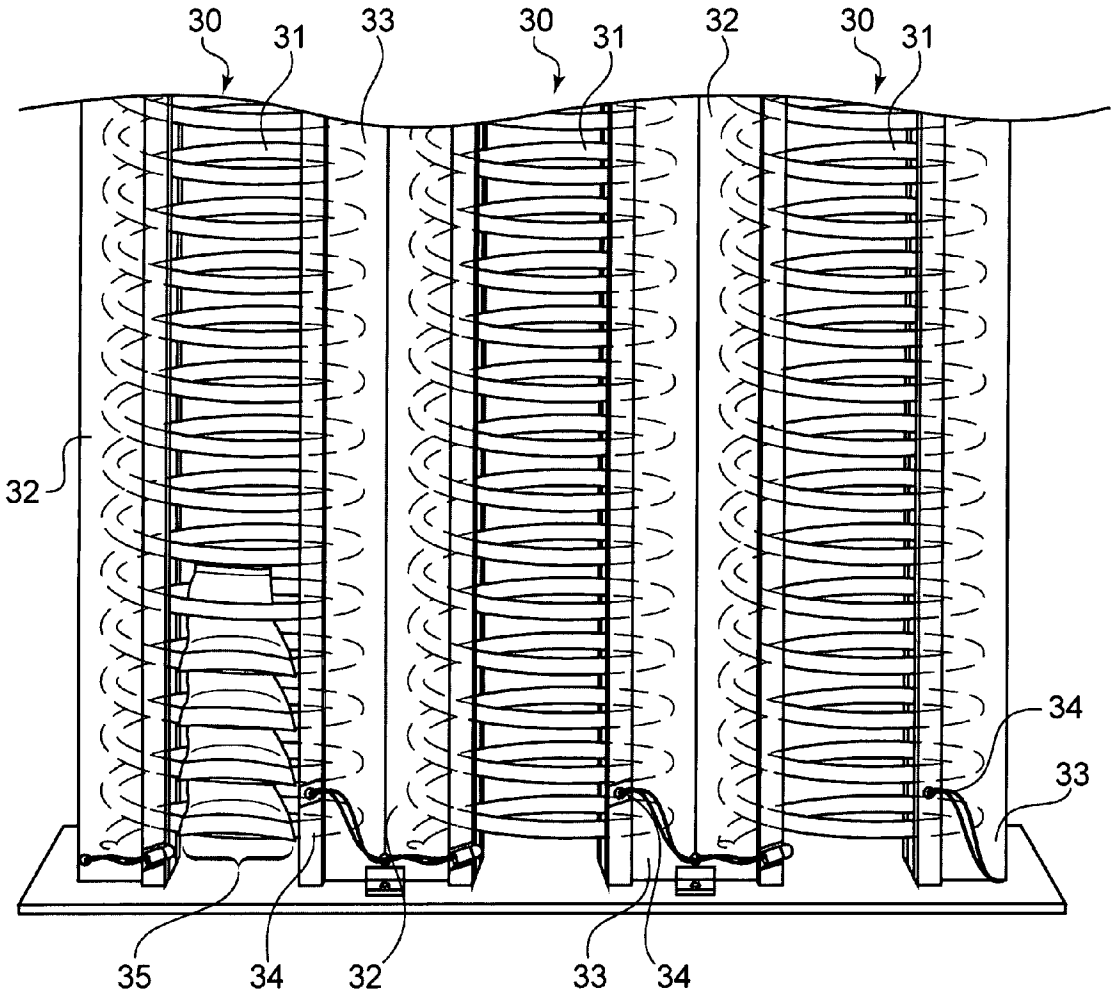
FIG. 2 shows a partial view of the interior vending compartments of the vending machine shown in FIG. 1.

Each vending chamber 30 is shown in FIG. 2. Each chamber 30 comprises a rotating coil 31 surrounded by side walls 32, 33. A set of elongated products 40 can be placed within the spaces in each coil 31 and are released from coil 31 as coil 31 rotates. When a product 40 reaches the bottom of coil 31, it is dropped into the dispensing slot 18 for retrieval by the purchaser. As with a standard vending machine, coils 31 rotate in response to the proper funds being deposited in the machine and a selection of one of the vending chambers 30 being made from buttons 14-16. The rotation of coils 31 can occur via a motor 50 (FIG. 3) or other driving device and can be controlled by a microprocessor (not shown). When the proper funds are inserted, the motor rotates the coil a predetermined number of degrees, until a single product 40 is released from the coil and dropped in dispensing slot 18. In the drawings shown, the coils rotate counter-clockwise, so that the product progresses downward as the coil rotates. Coils having an opposite rotation, which are rotated clockwise to produce downward movement, could also be used.

As shown in FIG. 2, there is a sensor 34 disposed adjacent to the bottom of each coil 31. Sensor 34 indicates via lights 19-21 when there is no product left in each coil.

Figure 3:
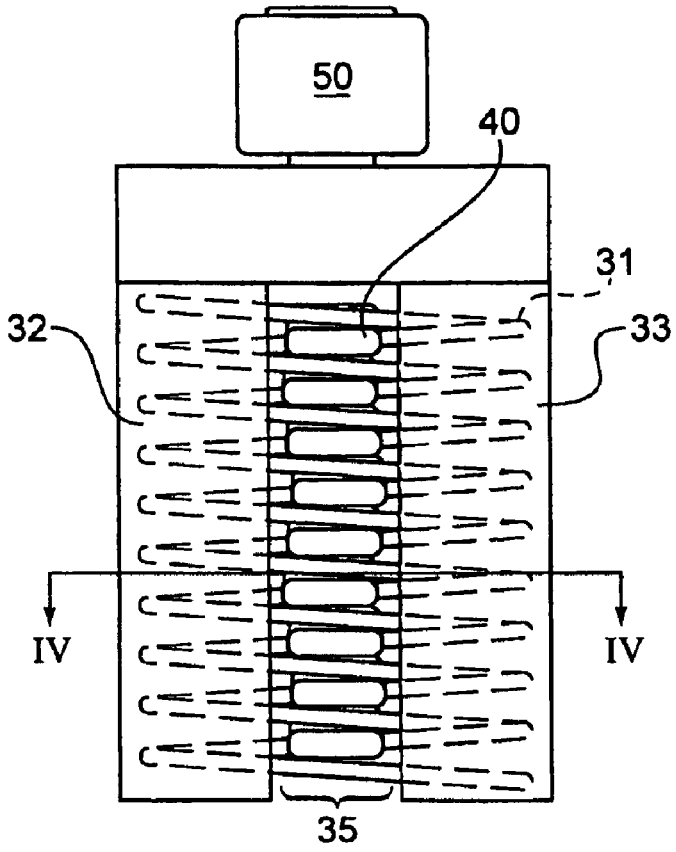
FIG. 3 shows a single vending compartment with products placed therein.
Figure 4:
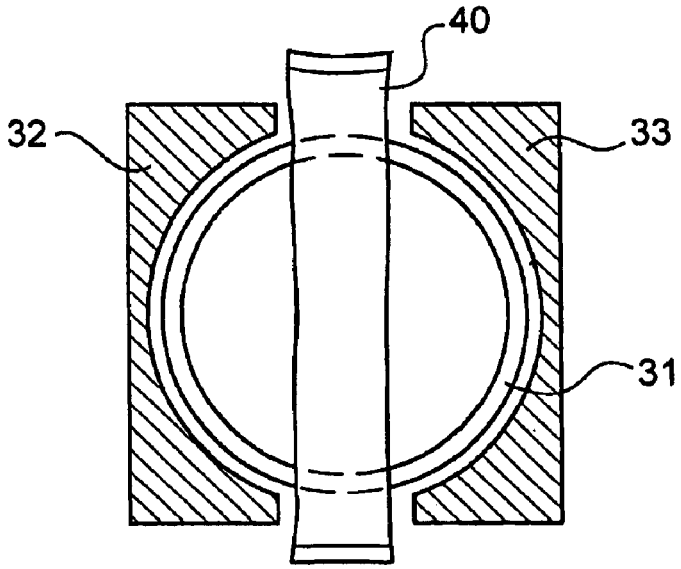
FIG. 4 shows a cross-sectional view along lines IV-IV from FIG. 3.

As shown further in FIGS. 3 and 4, retaining walls 32 and 33 surround each coil and leave a gap 35 on opposite sides of each coil 31 to allow product 40 to extend therethrough. Retaining walls 32 and 33 prevent product 40 from rotating along with coil 31 as coil 31 rotates. If product 40 rotates along with coil 31, it will not progress downward along coil 31 during rotation and thus no products will be vended. Gap 35 allows product 40 to extend out from opposite sides of coil 31, and abut the sides of retaining walls 32 and 33 as coil 31 rotates. The machine according to the invention is especially useful for products that are elongated and do not fit well within a standard coil vending machine. Examples of these types of products are beef jerky, writing implements, and powdered drink mix tubes. If such products are used, the preferred gap size is a approximately 0.5 inches. However, coils and gaps can be manufactured of various different sizes, to accommodate many different types of products. Retaining walls 32 and 33 keep products 40 in alignment in coils 31 and allow for smooth vending out of the bottom of coils 31. The vertical arrangement of coils 31 is also beneficial, because it uses gravity to help push the products downward along coils 31. It also prevents products 41 from becoming stuck at the end of any coil 31, which often happens with standard horizontal coils.

Accordingly, while only a few embodiments of the present invention have been shown and described, it is obvious that many changes and modifications may be made thereunto without departing from the spirit and scope of the invention.

What is claimed is:

1. An apparatus for vending packaged items, comprising:

a housing;

at least one rotatable dispensing coil disposed within said housing, said coil having a vertically oriented longitudinal axis and rotating such that products placed within said coil move progressively downward as the coil rotates, until each product is ejected from a bottom end of said coil;

two retaining walls surrounding said at least one coil on opposite sides of said coil, said walls extending an entire length of said coil, said walls being separated from each other by two longitudinally extending gaps located on opposite sides of said coil, such that a product having a length exceeding a diameter of said coil can be placed in said coil for vending with ends of said product extending beyond said coil through said gaps and abutting edges of said retaining walls when said coil rotates, and wherein said retaining walls prevent said product from rotating when said coil rotates.

2. The apparatus according to claim 1, further comprising a motor for driving the coil, and a funds receiving device connected to said motor, wherein said motor causes the coil to rotate a predetermined number of degrees when a predetermined amount of money is placed in said funds receiving device.

3. The apparatus according to claim 1, further comprising a slot in a bottom area of said housing for retrieving products ejected from said coil.

4. The apparatus according to claim 1, wherein there are at least three coils disposed in the housing.

5. The apparatus according to claim 1, further comprising a sensor mounted near a bottom end of said coil, said sensor sensing when there are no products remaining in said coil.

6. The apparatus according to claim 5, wherein said sensor is connected to a display for notifying customers when the product is sold out.

7. The apparatus according to claim 1, wherein each of said gaps is approximately 0.5 inches in diameter.

8. The apparatus according to claim 1, wherein the retaining walls have a semi-circular cross-section.

* * * * *